US006983909B2

(12) United States Patent
Bilskie et al.

(10) Patent No.: US 6,983,909 B2
(45) Date of Patent: Jan. 10, 2006

(54) ROLL CHANGING APPARATUS

(75) Inventors: Eric Joseph Bilskie, Factoryville, PA (US); Wade Lynn Bleich, Middletown, OH (US); William Howard Kinsey, Cherry Township, PA (US); John Anthony Giordano, Tunkhannock, PA (US)

(73) Assignee: The Procter & Gamble Company, Cincinnati, OH (US)

( * ) Notice: Subject to any disclaimer, the term of this patent is extended or adjusted under 35 U.S.C. 154(b) by 152 days.

(21) Appl. No.: 10/788,873

(22) Filed: Feb. 27, 2004

(65) Prior Publication Data

US 2005/0189449 A1 Sep. 1, 2005

(51) Int. Cl.
*B65H 67/00* (2006.01)

(52) U.S. Cl. ..... 242/559.1

(58) Field of Classification Search ..... 242/559.1, 242/559.2, 559.3, 558, 561, 533.2, 533.3; 414/910, 911

See application file for complete search history.

(56) References Cited

U.S. PATENT DOCUMENTS

| | | | | |
|---|---|---|---|---|
| 1,026,369 | A * | 5/1912 | Robeson | 242/559.1 |
| 1,655,226 | A | 1/1928 | Higgins et al. | |
| 2,194,125 | A * | 3/1940 | Rinchart | 414/910 |
| 3,062,465 | A * | 11/1962 | Hunter | 242/533.2 |
| 4,298,173 | A * | 11/1981 | Johansson | 242/558 |
| 4,373,854 | A * | 2/1983 | Schultheis | 414/911 |
| 4,767,076 | A * | 8/1988 | Tagawa | 242/559.1 |
| 4,807,526 | A | 2/1989 | Troyer et al. | |
| 4,905,925 | A | 3/1990 | Kremar | |
| 5,289,985 | A | 3/1994 | Cocchi et al. | |
| 5,906,333 | A | 5/1999 | Fortuna et al. | |
| 5,934,604 | A | 8/1999 | Klimek | |
| 2004/0206848 | A1 | 10/2004 | Martinez | |
| 2005/0017118 | A1 | 1/2005 | Finetti et al. | |

FOREIGN PATENT DOCUMENTS

| | | | |
|---|---|---|---|
| DE | 41 41 216 A1 | | 6/1992 |
| JP | 54-039346 | | 3/1979 |
| JP | 5-221565 | * | 8/1993 |

* cited by examiner

*Primary Examiner*—William A. Rivera
(74) *Attorney, Agent, or Firm*—Peter D. Meyer; David K. Mattheis; David M. Weirich

(57) ABSTRACT

An apparatus exchanges a roll remnant and a full roll. The apparatus comprises a dump cradle and a roll-transfer surface. The roll-transfer surface includes an extension element capable of transitioning between a retracted position and an extended position. The apparatus also includes a roll-delivery element capable of providing a fresh roll of material to the dump cradle and of removing a remnant of a previous roll from the apparatus.

20 Claims, 5 Drawing Sheets

ROLL CHANGING APPARATUS

FIELD OF THE INVENTION

This invention relates to apparatus capable of providing a wound roll of material to a material-handling process. Specifically, the invention relates to apparatus for exchanging a first wound roll of material, particularly a depleted roll of material, or roll remnant, for a second wound roll of material. The invention relates particularly to the handling of rolls of paper web materials.

BACKGROUND OF THE INVENTION

Web materials are a ubiquitous part of daily life. Materials such as papers, plastic films, and metals may be processed by winding the material into a large roll having a roll core and subsequently unwinding the material from the large roll as a step in a process to convert the material into a finished product.

As the rolls of material are wound, a roll may be wound to a particular size and then the winding of the roll is stopped. The finished roll may be removed, an empty core provided and the winding of a subsequent roll begun.

During the unwinding of the material, a roll may be unwound until the useable portion of the roll is removed. The roll remnant may be removed, a subsequent roll installed and then unwound.

The exchange of a finished roll for a new roll core, or of a roll remnant for a fresh roll, may cause a stoppage of the web handling process. This stoppage may reduce the overall productivity of the process. Time spent by personnel and equipment making this exchange, is time taken away from other tasks. It is desirable to exchange the rolls as quickly and efficiently as possible. Quick and efficient exchanges may increase productivity by reducing the duration of process stoppages and also by reducing the time spent on the exchanges thereby freeing equipment and personnel for other tasks.

SUMMARY OF THE INVENTION

A roll-handling apparatus of the invention exchanges a roll remnant (remnant) and a full roll of material having a radius of about R. The roll-handling apparatus comprises a dump cradle capable of transitioning between a roll-support position and a roll-release position. The roll-handling apparatus further comprises a roll-transfer surface capable of receiving the remnant from the dump cradle. The roll-transfer surface comprises an extension element. The extension element is capable of transitioning from a retracted position to an extended position. The remnant may be transferred from the dump cradle to the extended position. The extended position may coincide with a roll-removal position. The roll-handling apparatus further comprises a roll-delivery element capable of placing a fresh roll of material on the dump cradle and subsequently removing the remnant from the roll-removal position.

In another aspect the apparatus further comprises a trolley capable of transitioning between a roll-loading station and a roll-unwinding station. The trolley may comprise the dump cradle, and roll-transfer surface.

The apparatus of the invention may facilitate the delivery of a new roll and the subsequent removal of a remnant during a single trip of the roll delivery element.

BRIEF DESCRIPTION OF THE DRAWINGS

While the claims hereof particularly point out and distinctly claim the subject matter of the present invention, it is believed the invention will be better understood in view of the following detailed description of the invention taken in conjunction with the accompanying drawings in which corresponding features of the several views are identically designated and in which:

DETAILED DESCRIPTION OF THE INVENTION

Figure 1:
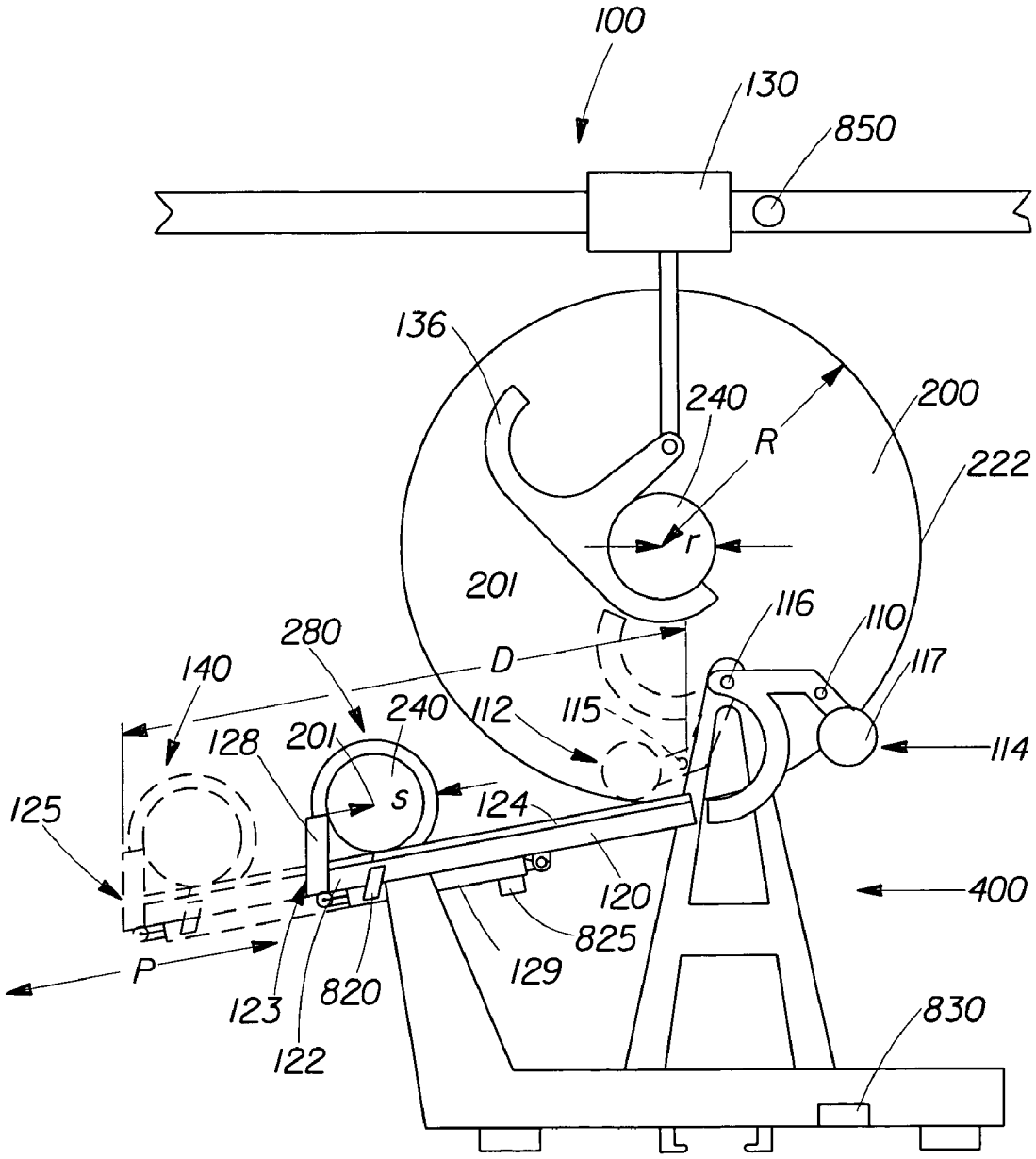
FIG. 1 is a schematic side view of one embodiment of the apparatus of the invention.

The following description is applicable to the handling of rolls of web material. The nature of the web material is not a limitation of the apparatus. The apparatus may be configured to handle rolls of any web material. The apparatus may be configured to handle paper, polymeric, metal or other web materials. As illustrated in FIG. 1, the apparatus 100 comprises a dump cradle 110, a roll-transfer surface 120, and a roll-delivery element 130. The dump cradle 110 is capable of transitioning from a roll-support position 112 to a roll-release position 114. A roll remnant, or remnant, 280, may be released by the dump cradle 110 and may be received by the roll-transfer surface 120. The roll-transfer surface 120 comprises an extension element 122. The extension element 122 is capable of transitioning from a retracted position 123 to an extended position 125. The remnant 280 may be transferred to the extended position 125. The extended position 125 may coincide with a roll-removal position 140. The roll-delivery element 130 may provide a fresh roll 200 and may place the roll 200 on the dump cradle 110 when the dump cradle 110 is in the roll-support position 112. The roll-delivery element 130 may subsequently remove the remnant 280 from the roll-removal position 140.

Figure 2A:
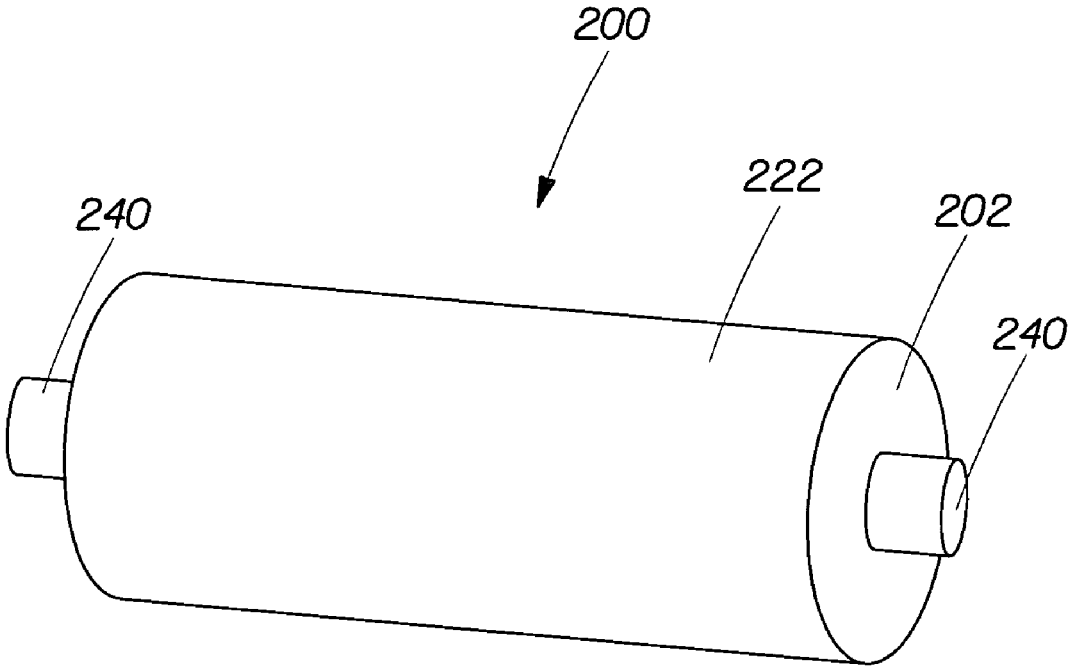
FIG. 2A is a schematic perspective view of a roll handled according to one embodiment of the invention.
Figure 2B:
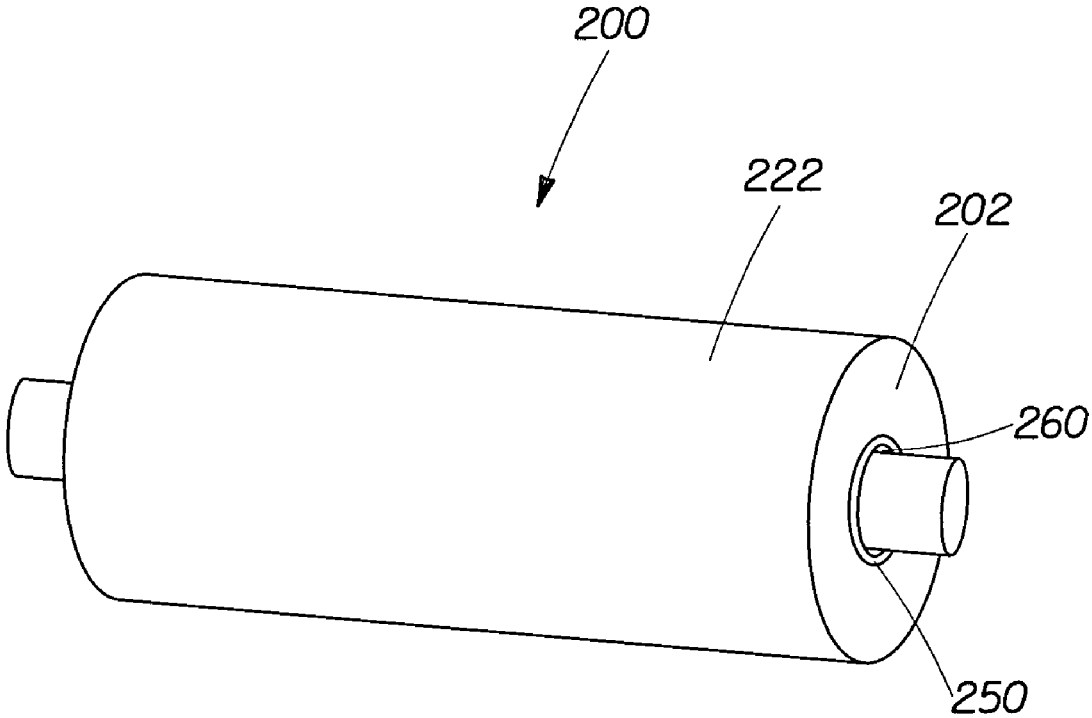
FIG. 2B is a schematic perspective view of a roll handled according to another embodiment of the invention.

The Roll:

The roll 200 may comprise any generally cylindrical roll of web material W wound about a central axis 201. As illustrated in FIGS. 2*a* and 2*b* the cylindrical roll 200 has a diameter and a width. The roll 200 has a circumferential surface 222, and two sides 202. The roll 200 may be wound on a central shaft 240, or a hollow core 250, coincident with the central axis 201 of the roll 200. Portions of the central shaft 240 or hollow core 250 may protrude beyond the sides 202 of the roll 200. The hollow core 250 may alternatively be generally flush with the sides 202 of the roll 200.

In one embodiment, rolls 200 having generally flush hollow cores 250 may have core inserts 260, inserted into the hollow cores 250. The core inserts 260 may protrude from each of the sides 202 of the rolls 200. The central shaft 240 and core inserts 260 may provide surfaces for the dump cradle 110 to support.

The size of the roll 200 is not a limitation of the apparatus of the invention. The apparatus 100 may be scaled appropriately to handle rolls of any particular dimensions.

The Apparatus:

The hereinafter described apparatus components may be comprised of metal, wood, glass, composite, or other materials appropriate to the intended use of the component as are known in the art.

The Dump Cradle:

The dump cradle 110 may comprise a single dump cradle 110 or a plurality of dump cradles 110. In the embodiments illustrated in FIGS. 1, 3, and 4, the dump cradle 110 comprises a pair of dump cradles 110 disposed one at each end of the roll 200. Each dump cradle 110 is capable of supporting the roll 200 via a surface extending beyond a side 202 of the roll 200.

The dump cradle 110 may be configured to transition between the first roll-support position 112 and the second roll-release position 114 utilizing any means known in the art. In one embodiment, illustrated in FIG. 1, the dump cradle 110 may be configured to use the force of gravity to transition between the roll-support position 112 and the roll-release position 114. In this embodiment, the dump cradle 110 may be maintained in the roll-support position 112 by the presence of a pawl 115 interfering with the movement of the dump cradle 110 to the roll-release position 114. In this embodiment, the mass of the remnant 280 may act upon a pivot point 116 of the dump cradle 110 to create a torque about the dump-cradle pivot point 116. The torque may be countered by the presence of the pawl 115 interfering with the rotation of the dump cradle 110 about the pivot point 116. The dump cradle 110 may also be released from the roll-support position 112 by the use of a cog, a solenoid actuated release, or other means know in the art.

The pawl 115 may be withdrawn at the discretion of an operator either manually or automatically, and either locally or remotely. The withdrawal of the pawl 115 enables the dump cradle 110 to rotate in response to the torque created by the presence of the remnant 280 in the dump cradle 110.

The remnant 280 may be released by the dump cradle 110 at a point between the roll-support position 112 and the roll-release position 114, or the remnant 280 may be released at the roll-release position 114. When the remnant 280 is released from the dump cradle, the torque associated with the remnant 280 will be removed and the dump cradle 110 may rotate back to the roll-support position 112 by way of an oppositely directed torque arising from the action of gravity upon an appropriately sized and positioned counterweight 117. The pawl 115 may be repositioned to interfere with the rotation of the dump cradle 110 between the roll-support position 112 and the roll-release position 114 as, or after, the dump cradle 110 returns to the roll-support position 112. The size and position of the counterweight 117 may be such that the torque associated with the lightest possible remnant 280 is greater than the counterweight torque, and is sufficient to cause the rotation of the dump cradle 110 between the roll-support position 112 and the roll-release position 114. Other configurations of the counterweight are possible such that the motion of the dump cradle as it transitions between positions is in accordance with the needs of the roll-handling process.

Figure 4:
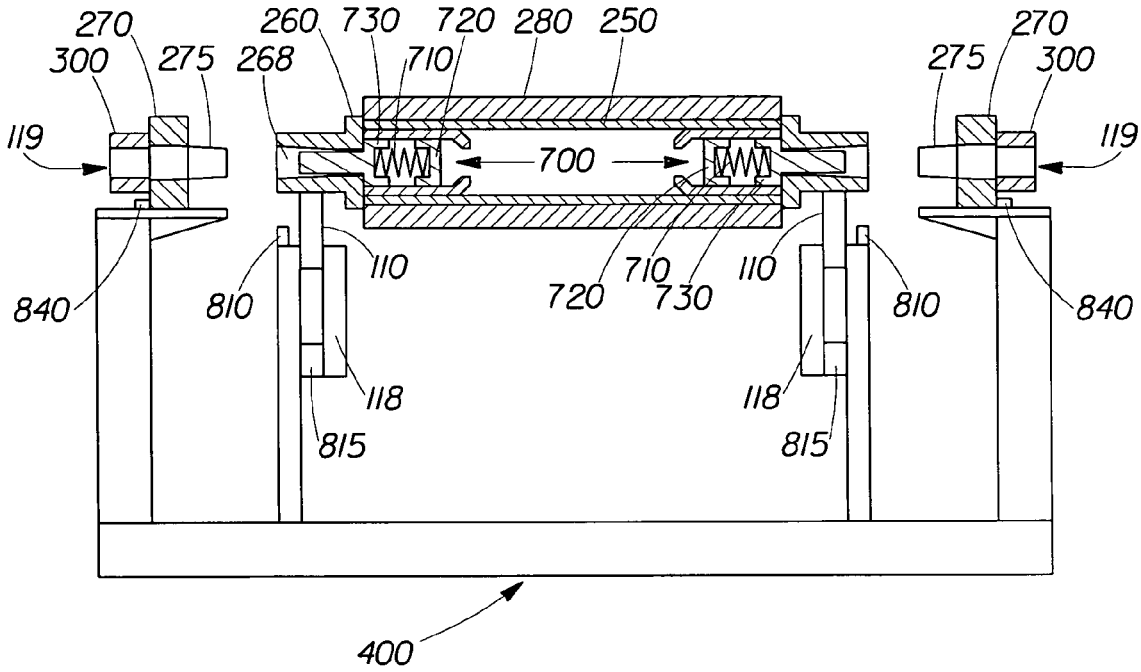
FIG. 4 is a schematic sectional view of FIG. 3 taken along section line 4—4 of FIG. 3.

In the embodiment illustrated in FIG. 4, the dump cradle 110 may be transitioned by the action of a dump-cradle end effector 118. A single dump-cradle end effector 118 may enable both transitions, or an opposed pair of dump-cradle end effectors 118 may be used to enable the transitions. Exemplary end effectors include, without being limiting, pneumatic or hydraulic cylinders, linear servo motors, linear actuators, a rack and pinion system coupled to a cylinder or a rotary actuator, a belt drive system driven by an electric, hydraulic, or pneumatically powered motor, a system of chains and sprockets, and other means of generating motion as are known in the art.

In another embodiment (not shown), the dump cradle may be capable of transitioning from a first roll-receipt position to a second roll-support position to a third roll-release position. The dump cradle may be transitioned between these respective positions by the above described potential or kinetic energy actuators, and/or combinations thereof.

Figure 3:
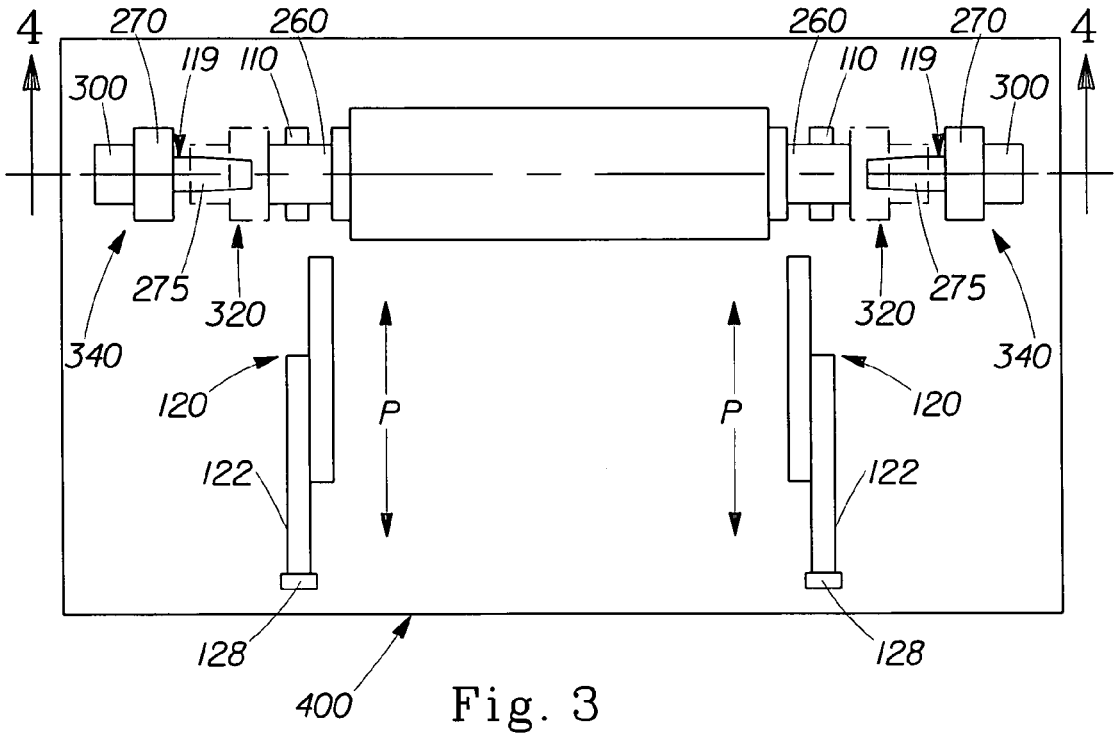
FIG. 3 is a schematic plan view of a trolley according to one embodiment of the invention.

The Roll-Engaging Element:

The apparatus may comprise at least one roll-engaging element. The roll-engaging element may be adapted to engage the hollow core 250, central shaft 240, or core insert 260, (collectively considered the engaged roll element) of the roll 200. As shown in FIGS. 3 and 4, the engaging element 119 may comprise an actuator shaft 275 capable of engaging the hollow core 250, or appropriate cavities in the ends of the central shaft 240 or the core inserts 260. The actuator shaft 275 may comprise splines or a tapered shaft matched with a splined or tapered cavity of the engaged roll element. The actuator shaft 275 may comprise an expanding chuck inserted into the engaged roll element and then circumferentially expanded mechanically, pneumatically, or hydraulically. The actuator shaft 275 may comprise partial, or complete, threads matched to threads in the engaged roll element. The engagement between the actuator shaft and the engaged roll element may be by other means as are known in the art.

The engagement of the engaging element 119 and the engaged roll element, may lift the roll 200 from the support of the dump cradle 110 such that the roll 200 is supported by the engaging element 119. The engaging element 119 may comprise one or more bearing elements 270 capable of supporting the roll 200 as the roll 200 is rotated. These bearing elements 270 may be rotating-element bearings, solid-material bearings, journal bearings, or other types of bearings as are known in the art. The bearing elements may engage and support the roll via the outside surface of central shafts 240 or core inserts 260. The bearing elements 270 may engage and support the actuator shafts 275 which in turn engage and support the roll 200. The engaged roll element may also comprise bearing surfaces (not shown) that engage and support the actuator shaft 275 as it engages the engaged roll element.

The engaging element 119 may comprise a roll end effector 300. The roll end effector may be coupled to the actuator shaft 275. The roll end effector 300 may be electrically, mechanically, hydraulically, or pneumatically rotated to rotate the roll 200. The roll 200 may be rotated to unwind the material W. Alternatively, the roll 200 may be rotated to wind material W.

In another embodiment, the roll 200 may be rotated while held by the dump cradle 110, or the engaging elements 119, by a surface winding mechanism (not shown). The surface winding mechanism may contact the circumferential surface 222 of the roll 200 to rotate the roll 200 and unwind the web material W from the roll 200.

The engaging element 119 may be transitioned from a disengaged position 310 to an engaged position 320 and back to the disengaged position 310. The engaging element 119 may move along at least a portion of the winding axis to engage the roll 200. The engaging element 119 may move linearly, by rotation, along a path defined by the motion of a cam follower along a cam, and any combination of these, into engagement with the roll 200. The engaging element 119 may slide along a surface, may move in conjunction with a cylinder, or a rack and pinion system (not shown). The engaging element 119 may move in conjunction with a roll-engaging-element end effector (not shown). Exemplary end effectors include, without being limiting, pneumatic or hydraulic cylinders, linear servo motors, linear actuators, a rack and pinion system coupled to a cylinder or a rotary actuator, a belt drive system driven by an electric, hydraulic, or pneumatically powered motor, a system of chains and sprockets, and other means of generating motion as are known in the art.

In an embodiment where the engaging element 119 engages a core insert 260, the disengaging of the engaging element 119 from the core insert 260, may be problematic. The transition of the engaging element 119 from the engaged position 320 to the disengaged position 310, may cause the core insert 260 to at least partially disengage from the hollow core 250. In the embodiment, illustrated in FIG. 4, the core insert 260 comprises an ejector 700 capable of exerting a force in opposition to the withdrawal of the engaging element 119. The exertion of this force may maintain the engagement of the core insert 260 with the hollow core 250.

The ejector 700 may comprise a spring actuated system. As shown in FIG. 4, a spring 710 is constrained between a base 720 and a cap 730. The cap 730 is configured to contact the engaging element 119 as the engaging element 119 is inserted into the cavity 268 of the core insert 260. The motion of the engaging element 119 into the cavity 268, compresses the spring 710. As the engaging element in withdrawn from the cavity 268, the expansion of the spring 710 functions to disengage the engaging element 119 from the cavity 268 and to forcibly maintain the core insert 260 in engagement with the hollow core 250. In this embodiment, the spring may be any compression spring capable of decoupling the engaging element 119 from the cavity 268. The base 720 and the cap 730 may be cast or machined from any material capable of enduring the stresses of the ejection. Appropriately selected woods, polymers, or metals may be used for the cap 730 and the base 720. Ultra-high-molecular-weight plastic is a non-limiting example of a material suitable for the cap 730 and the base 720.

In an alternative embodiment (not shown) the ejector 700 may comprise a pneumatic cylinder wherein the cylinder is compressed as the engaging element 119 engages the core insert 260, and the cylinder extends as the engaging element 119 is withdrawn. The cylinder in this embodiment may be actively powered or may be a sealed cylinder relying upon the expansion of the previously compressed gas to extend the cylinder to eject the engaging element 119.

Other means of generating a reactive force in opposition to the withdrawal of engaging element 119 as are known in the art may be used to maintain the engagement of the core insert 260 with the hollow core 250.

The Roll-Transfer Surface:

When the dump cradle 110 transitions to the roll-release position 114, the remnant 280 may be released by the dump cradle 110 and received by the roll-transfer surface 120. The roll-transfer surface 120 defines a roll-transfer path P. The remnant 280 travels along the roll-transfer path P proceeding from the dump cradle 110 to a roll-removal position 140. The roll-transfer surface 120 may comprise a single surface or a plurality of surfaces across the width of the remnant 280, and along the length of the roll-transfer path P. The roll-transfer surface 120 may be configured to support the entire circumferential surface 222 of the remnant 280 or only a portion of the surface. The roll-transfer surface 120 may be configured to support only the portions of the remnant 280 extending beyond the sides 202 of the web material W of the remnant 280.

The roll-transfer surface 120 may proceed at a decline over at least a portion of the roll-transfer path P from the dump cradle 110, to enable the remnant 280 to move along the roll-transfer path P due to gravitational forces. The roll-transfer surface 120 may comprise one or more powered conveying surfaces (not shown) capable of transferring the remnant 280 from the dump cradle 110 to the roll-removal position 140. With this option, the roll-transfer surface 120 may decline from the dump cradle 110, may incline from the dump cradle 110 may be level with the dump cradle 110.

The roll-transfer surface 120 may comprise one or more roll-contacting surfaces 124 which contact at least a portion of the roll 200 or a surface protruding from the sides 202 of the roll 200. The roll-contacting surfaces 124 may be comprised of any material suitable for the efficient transfer of the rolls 200 along the roll-transfer path P. Any, or all, of the roll-contacting surfaces 124 of the roll-transfer surface 120 may be surface hardened, coated with a high wear coating, such as a plasma coating or a chromium coating, or prepared by other means known in the art for extending the service life of a wear surface. The roll-contacting surfaces 124 may comprise a sacrificial wear element (not shown) capable of easy replacement and intended to efficiently transfer the remnant 280. A low friction ultra-high-molecular-weight polymeric material, and a steel wear strip are non-limiting examples of sacrificial wear elements.

The roll-transfer surface 120 may comprise an extension element 122 capable of transitioning from a retracted position 123 to an extended position 125. The terms extended and retracted are not to be construed as limiting the motion of the extension element 122 to a reciprocal motion. The terms refer to an extension of the roll-transfer path P. The roll-transfer path P is lengthened as the extension element 122 transitions to the extended position 125 and shortened as the extension element 122 transitions to the retracted position 123.

The extension element 122 may comprise a single roll-contacting surface or a plurality of roll-contacting surfaces. The extension element 122 may be configured to contact all or only a portion of the remnant 280 or the surfaces protruding from the sides 202 thereof. The extension element may comprise the above described roll-contacting surfaces 124.

In one embodiment (not shown), the extension element 122 may be transitioned between the retracted position 123 and the extended position 125 by way of gravity. The design of the extension element 122 may provide for the transition from the retracted position 123 to the extended position 125 by gravity acting upon the remnant 280 in conjunction with the extension element 122 to instigate the transition. The subsequent removal of the remnant 280 from the extension element 122 would instigate the transition to the retracted position 123 by the action of gravity upon an appropriate counterweight.

Returning to the embodiment, illustrated in FIG. 1, the extension element 122 may be transitioned between the retracted position 123 and the extended position 125 by the use of one or more end effectors 129. A single end effector 129 may enable both transitions, or an opposed pair of end effectors 129 may be used to enable the transitions. Exemplary end effectors include, without being limiting, pneumatic or hydraulic cylinders, linear servo motors, linear actuators, a rack and pinion system coupled to a cylinder or a rotary actuator, a belt drive system driven by an electric, hydraulic, or pneumatically powered motor, a system of chains and sprockets, and other means of generating motion as are known in the art.

The roll-transfer surface 120 may further comprise one or more roll stops 128. Roll stops 128 are capable of limiting the motion of the remnant 280 along the roll-transfer surface 120. The roil stops 128 may be positioned at the portion of the roll-transfer surface 120 furthest from the dump cradle 110. The roll stops 128 may comprise a cushioned stop comprising a shock-absorbing cylinder, shock-absorbing foam, spring loaded stops, or other impact absorbing elements. The roll stops 128 may also comprise a fixed stop with little shock-absorbing capability, and/or other motion inhibiting means as are known in the art.

In one embodiment, the roll-transfer surface 120 may receive the remnant 280 from the dump cradle 110 when the extension element 122 is in the retracted position 123. The remnant 280 may proceed along the roll-transfer surface 120 stopping at the roll stop 128. The roll-transfer surface 120 may then extend as described, carrying the remnant 280 with it to the extended position 125.

In an alternative embodiment, the roll-transfer surface 120 may extend prior to the transfer of the remnant 280 from the dump cradle 110 to the roll-transfer surface 120. In this embodiment, the remnant 280 may proceed along the roll-transfer path P from the dump cradle 110 to the extended position 125 of the extension element 122. In another embodiment, the extension element 122 may transition from the retracted position 123 to the extended position 125 as the remnant 280 is proceeding along the roll-transfer surface 120.

The position of the remnant 280 at the roll stop 128 when the extension element 122 is in the extended position 125 may coincide with the roll-removal position 140. In the embodiment illustrated in FIG. 1, the extended position 125 may allow the remnant 280 to move a distance greater than the radius R of the subsequent roll 200 from the dump cradle 110. The dump cradle 110 may be repositioned to the roll-support position 112 after the remnant 280 has been released from the dump cradle 110. The disposition of the remnant 280 at a roll-removal position 140, more than the radius R from the dump cradle, enables the roll-delivery element 130 to dispose a subsequent roll 200 onto the dump cradle 1110, prior to removing the remnant 280 from the roll-removal position 140.

In an alternative embodiment (not shown) the remnant 280 may proceed beyond the extended position 125 of the extension element 122 to a roll-removal position 140 further from the dump cradle 110. In this embodiment, the extension element 122 provides a retractable bridge between portions of the roll-transfer surface 120 enabling the transit of the remnant 280 from one portion to the next and ultimately to the roll-removal position 140.

The distance D between the roll-removal position 140 and the dump cradle 110 will determine the maximum diameter remnant 280 that may be transferred to the roll-transfer surface while still providing sufficient space in the apparatus 100 for the disposition of a new roll 200 of radius R on the dump cradle 110. The distance D−R will limit the size of the remnant 280 that can be transferred. The specific configuration of the apparatus will determine how the distance D−R relates to the maximum remnant 280 size. FIG. 1 illustrates as an example, a roll-transfer surface 120 configured with roll-contacting surfaces 124 that contact the central shaft 240 and not the material W of the remnant 280. For this configuration, the Distance D−R will accommodate a remnant 280 having a central shaft 240 radius of r and an overall radius of S up to the limit where r+S=D−R. It is possible to configure the apparatus such that the distance D is greater than the distance r+2R. This configuration would permit a full roll 200 to be released as a remnant 280 and still provide sufficient space for the disposition of a subsequent roll 200 prior to the removal of the full roll remnant.

The above described configuration is not limited to the handling of rolls wound on a central shaft. Rolls 200 wound on a hollow core 250 may be accommodated up to the limit that the radius r of the component in contact with the roll-transfer surface and roll stop satisfies the equation r=D−R−S.

Figure 5A:
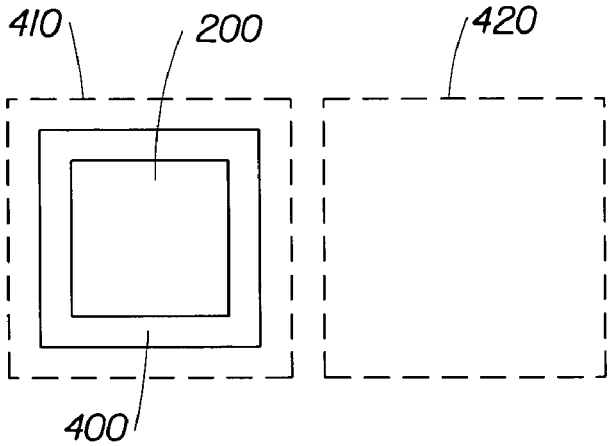
FIG. 5A is a schematic plan view of a trolley and trolley stations according to one embodiment of the invention.
Figure 5B:
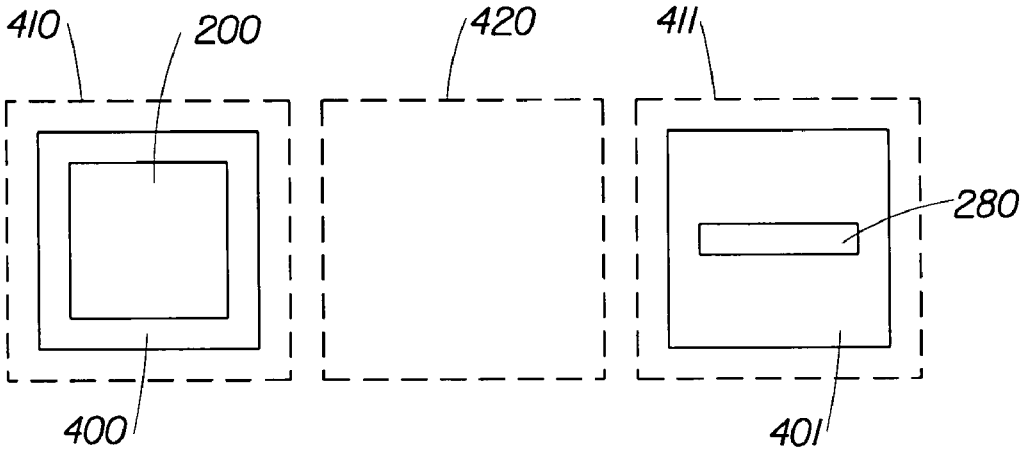
FIG. 5B is a schematic plan view of two trolley and trolley stations according to another embodiment of the invention.

The Trolley:

As shown in FIGS. 3 and 4, the dump cradle 110, engaging element 119, and roll-transfer surface 120 may comprise portions of a trolley 400. As shown in FIG. 5A, the trolley 400 may be capable of transitioning from a first roll-loading location 410 to a roll-unwinding location 420. In another embodiment shown in FIG. 5B, two trolleys may be disposed such that the first trolley 400 transitions between a first roll-loading location 410 and the roll-unwinding location 420, and a second trolley 401 transitions between a second roll-loading location 411 and the roll-unwinding location 420. In this embodiment, the first trolley 400 receives a roll 200 at the first roll-loading location 410. The first trolley 400 transitions from the first roll-loading location 410 to the roll-unwinding location 420 and the roll 200 is unwound. The second trolley 401 receives a roll 200 of material at the second roll-loading location 411. The first trolley 400 moves from the roll-unwinding location 420 to the first roll-loading location 410 to exchange the remnant 280 of the first roll 200 for a subsequent fresh roll 200 of material. The second trolley 401 moves from the second roll-loading location 411 to the roll-unwinding location 420 and the second roll 200 is unwound. The trolleys 400, 401 alternate between their respective roll-loading locations 410, 411 and the roll-unwinding location 420.

Figure 5C:
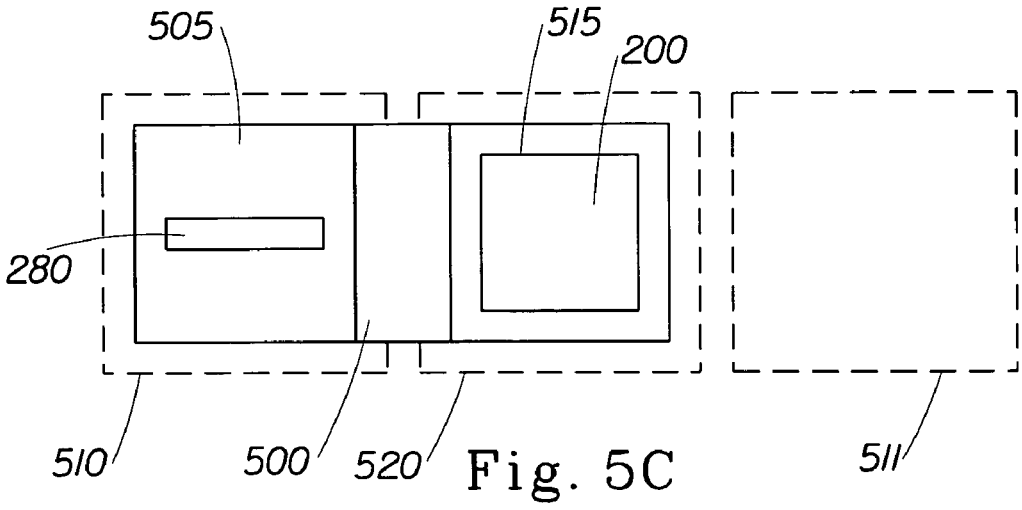
FIG. 5C is a schematic plan view of a multi-roll trolley and trolley stations according to yet another embodiment of the invention.

In another embodiment, shown in FIG. 5C, a single trolley 500 may comprise two roll-handling stations 505 and 515. In this embodiment, a first roll-handling station 505 may be present at the first roll-loading location 510 when the second roll-handling station 515 is present at the roll-unwinding station 520. When the trolley 500 transitions, the first roll-handling station 505 may move to the roll-unwinding location 520, the second roll-handling station 515 may move to the second roll-loading location 511 and may exchange a remnant 280 for a fresh roll 200. After the roll 200 in the first roll-handling station 505 has completed processing, the trolley 500 may transition such that the second roll-handling station 515 moves from the second roll-loading location 511 to the roll-unwinding location 520. Either one, or both, trolley roll-handling stations may comprise any of the above described remnant-handling elements and combinations thereof.

The general operation of a roll-handling trolley with respect to the motion enabling devices for the trolley is well known in the art and will not be further discussed.

The Roll-Delivery Element:

Returning to FIG. 1, the roll-delivery element 130 may operate at least partly above the dump cradle 110 and roll-transfer surface 120. The roll-delivery element 130 may be of any design capable of effectively disposing a fresh roll 200 onto the dump cradle 110 and removing the remnant 280 from the roll-removal position 140. The roll-delivery element 130 may comprise a portion of an overhead gantry crane having an appropriate maximum weight limit. The roll-delivery element 130 may pick up a fresh roll 200 at a roll-storage location (not shown). The roll-delivery element 130 may convey the roll 200 vertically from the roll-storage location and then horizontally to the dump cradle 110. The roll-delivery element may then convey the roll 200 vertically into the dump cradle 110. The roll-delivery element 130 may subsequently remove the remnant 280 vertically from the roll-removal position 140. The general operation of a roll-delivery element 130, with respect to the motivational aspects of the element, is well known in the art and will not be further discussed.

The roll-delivery element 130 may be adapted to engage the engaged roll element of the roll 200. The roll-delivery element 130 may comprise a double hook 136. The double hook 136 enables the roll-delivery element 130 to dispose a roll 200 on the dump cradle 110 and subsequently pick up a remnant 280 from the roll-removal position 140 without the necessity of first passing the roll-removal position 140 and then returning to the roll-removal position 140.

System Control:

In one embodiment, the apparatus 100 may be controlled manually by a human operator. In this embodiment, the operator may control the initiation of each step of the operation of the apparatus. The operator may further control the cessation of each step and the successive initiation of any subsequent step. The operator may control the apparatus through the use of locally or remotely situated controls.

In another embodiment, the performance of any of the steps described above including without limitation: providing a fresh roll 200 at the dump cradle 110, removing the remnant 280 from the roll-removal position 140, transitioning extension element 122 of the roll-transfer surface 120 between an extended position 125 and a retracted position 123, transitioning the dump cradle 110 between a roll-support position 112 and a roll-release position 114, and transitioning a trolley 400 between a roll-loading location 410 and a roll-unwinding location 420, may be at least partially automated. Sensors may be provided to indicate the position of the roll-delivery element 130, the dump cradle 110, the extension element 122 of the roll-transfer surface 120, the engaging element 119, the trolleys 400, 401, 500, and combinations thereof. Additional sensors may be provided to indicate the position of the end effectors associated with the roll-delivery element 130, the dump cradle 110, the extension element 122 of the roll-transfer surface 120, the engaging element 119, the trolleys 400, 401, 500, and combinations thereof.

These sensors may be configured to continuously provide the location of the respective sensed component. The sensors may also be configured to provide discrete inputs when the sensed components have reached predetermined locations. The input provided by the sensor for a given component may be reconciled with the input provided by the sensor for the end effector corresponding to that component and/or the desired location for the given component provided from a control program. This reconciliation may enhance the safe operation of the machine. As an example, the input from the sensor for the dump-cradle end effector 118 of the dump cradle 110 may be referenced against the input value from the sensor for the dump cradle 110, and with the desired value for the position of the dump cradle 110 from the control program. In the event that the input values and control program do not agree, within an appropriately selected time window, the progress of the roll-handling equipment may be halted until the source of the disagreement may be identified and corrected. A predetermined time window for the reconciliation of the inputs and desired value may be utilized to reduce the occurrence of false indications of disagreement resulting from differences in sensor response times.

The above described sensors may be configured to best suit the motion of the particular component. By way of example and without being limiting: the dump cradle 110 may have a rotary motion between its respective positions and therefore a rotary encoder may be used to determine the position of the dump cradle 110. Linear position sensors may be used to provide the location of elements including the extension elements and the trolley. In one embodiment, sensors may be used to provide an indication of position associated only with each extreme position of the particular component. As a non-limiting example, a sensor may provide the location of the extension element 122 of the roll-transfer surface 120 only when the extension element 122 is in the retracted position 123 or in the extended position 125. In this embodiment, sensors may provide an input corresponding to the presence of the dump cradle 110 in each of the roll-support 112 and roll-releasing positions 114 but nowhere else. Also in this embodiment, the sensors may provide inputs corresponding to the location of the trolley 400 when the trolley 400 is disposed at either the roll-loading location 410 or at the roll-unwinding location 420. The sensors may provide inputs to a controller configured to automatically sequence the steps of providing a roll 200, removing a remnant 280, transitioning the trolley 400 and unwinding the roll 200.

FIG. 1 illustrates the placement of sensors to indicate the position of specific components. According to the figure, the extension-element-end-effector position sensor 825 indicates the position of the extension-element end effector 129. The extension-element position sensor 820 indicates the position of the extension element 122. The roll-delivery-element position sensor 850 indicates the position of the roll-delivery element 130. The trolley position sensor 830 indicates the position of the trolley 400.

FIG. 4 illustrates an exemplary placement of the dump-cradle position sensor 810, the dump-cradle-end-effector sensor 815, and the engaging-element position sensor 840 to provide indications of the dump cradle, the dump-cradle end effector, and the engaging element 119 respectively.

Additional sensors (not shown) may be provided to indicate other operational parameters such as the presence of a roll at a particular location, or the diameter of a roll during processing or during handling. The use of such sensors is well known in the art and will not be further discussed herein.

The above described sensors may communicate with one or more process controller (not shown). This communication may be by any means known in the art for communicating sensor information to a controller. Non-limiting examples of the communication means include hardwiring the output of the sensor to an input circuits of the controller, providing wireless link between the sensor and the controller, providing a multiplexed signal link between the sensor and the controller.

One or more display panels (not shown) may be adapted to provide textual and graphical information regarding the operation of the apparatus. As a non-limiting example, a graphic representation of the apparatus may be provided. The graphic representation may include real time input data as to the location of each component of the apparatus and also information relating to an associated web processing process. Color variations and the use of flashing graphic elements, as are known in the art, may be employed to provide additional information to a machine operator. As a non-limiting example, a flashing green image may be used to indicate that a trolley is transitioning from a roll-loading location to a roll-unwinding location. A red graphic may indicate a component e.g. a trolley, which should be moving, or should be at a location specified by the control program, but is not in the desired state according to the input value.

Light stacks (not shown) as are known in the art may be provided to enable a determination of the operation of the apparatus from a distance, or from locations where the display panel cannot be viewed accurately, if at all. These light stacks may use a combination of light color and operation to convey status information. A continuously lit green light may be used to indicate normal safe operation. A flashing green light may indicate that the apparatus is waiting on the downstream process. A flashing red light may indicate that an apparatus safety sensor has been activated. In this manner a considerable amount of information may be provided to a process operator in an efficient manner.

EXAMPLE 1

An apparatus for handling parent rolls of paper web material, the parent rolls having a diameter of about 100 inches (254 cm). Core plugs having stub shafts are inserted into each end of the core of the roll at a roll-storage location. The roll is transported from the roll-storage location to a position above a roll-loading location of a trolley. The trolley moves from a roll-unwinding location to the roll-loading location when the operator desires to change the remnant supported on the trolley.

As the trolley moves, engaging elements retract from a position of engagement with the core plugs of the remnant. Ejectors in the core plugs assist the disengagement of the engaging element from the core plugs. As the engaging elements are withdrawn, the remnant is lowered onto a pair of dump cradles.

A first sensor detects the position of the engaging elements to ensure that engaging elements are clear of the remnant. A second sensor detects the diameter of the remnant. Remnants having a diameter of less than 36 inches (91.4 cm) may be transferred to the roll-transfer surface. Larger remnants are precluded from being transferred to the roll-transfer surface due to the diameter capacity of the particular apparatus.

For remnants having diameters less than 36 inches (91.4 cm) the operator actuates the dump-cradle end effector to transition the dump cradles. The dump cradles change from the roll-support position to the roll-release position. The remnant is transferred from the dump cradles to the roll-transfer surface. The dump cradles are transitioned back to the roll-support position after the release of the remnant.

The remnant moves along the roll-transfer surface to the roll stop. After the remnant has reached the roll stop, an operator actuates an extension-element end effector to extend the extension element of the roll-transfer surface. The extension element and the remnant move to the roll-removal position.

The roll-delivery element disposes a new roll into the dump cradles. The engaging elements move into engagement with the roll lifting it from the support of the dump cradles. The roll-delivery element subsequently proceeds to the roll-removal position and removes the remnant. The extension element retracts and the trolley transitions to the roll-unwinding location. The roll-delivery element conveys the remnant to a remnant-handling station and then proceeds to the roll-storage location to pick up another new roll.

EXAMPLE 2

On command from a controller, a roll-delivery element picks up a new roll from a roll-storage location. The roll-delivery element conveys the roll to a position above a roll-loading station. A first sensor continuously inputs the position of the roll-delivery element to the controller. The motion of the roll-delivery element is stopped when the first sensor indicates that the roll has been conveyed to the roll-loading station.

An active roll having a hollow core is disposed in a pair of dump cradles on a trolley. The core of the roll is engaged by a pair of core insert stub shafts that protrude from the sides of the roll. The stub shafts are engaged and supported by a pair of retractable bearing elements capable of supporting the roll during axial rotation of the roll. A second sensor continuously inputs the position of the dump cradles to the controller. A third sensor continuously inputs the position of the retractable bearing elements to the controller. As the active roll is unwound, the diameter of the roll is reduced. A roll-diameter sensor determines the diameter the active roll. The unwinding of the active roll stops after the diameter of the active roll is determined to be at or below a predetermined threshold diameter.

On command from the controller, the trolley transitions from the roll-unwinding station to the roll-loading station. The position of the trolley is continuously input to a controller from a trolley-position sensor. The motion of the trolley is stopped when the trolley-position sensor indicates that the trolley is located at the roll-loading station.

The controller commands the bearing-elements end effector to retract the bearing elements from the stub shafts of the core inserts until the input from the third sensors indicates' that the bearing elements have transitioned to the retracted position of the bearing elements. As the bearing elements retract, the remnant is lowered to and supported by the pair of dump cradles.

The dump cradles transition from the roll-support position to a roll-release position by the action of a dump-cradle end effector at the command of the controller. The action of the dump-cradle end effector is halted when the second sensors indicate that the dump cradles have reached the roll-release position. The remnant of the roll transitions from the dump cradles to a roll-transfer surface. A dump-cradle roll-detecting sensor provides an input to the controller indicating that no roll is present in the dump cradle. The controller then provides an output to the dump-cradle end effector to reverse the motion of the end effector and to transition the dump cradle from the roll-release position to the roll-support location.

The remnant rolls along a declining roll-transfer surface stopping at a pair of roll stops situated in line with the stub shafts of the core inserts. A roll-stop roll-detection sensor provides an input to the controller indicating the presence of the remnant at the roll stops. The controller commands the extension-element end effector to transition the extension element from a retracted position to an extended position.

The motion of the extension element is halted when the extension-element position sensor indicates that the extension element has reached the extended position.

The controller commands the roll-delivery element to deposit the new roll into the dump cradles. The roll-delivery element lowers the new roll from a position above the roll-loading station into the dump cradles. The presence of the new roll is detected by the dump-cradle roll-detection sensor. The downward motion of the roll-delivery element continues after the roll is detected in the dump cradles for a predetermined amount of time until a roll-engaging element of the roll-delivery element has disengaged the stub shafts of the core inserts of the new roll.

The roll-delivery element transitions horizontally, at the command of the controller, from the roll-loading station to the roll-removal position. Once the roll-delivery-element-position sensor indicates to the controller that the roll-delivery element is located at the roll-removal position, the roll-engaging element of the roll-delivery element is raised to engage the remnant. The roll-engaging element continues to rise until a predetermined time delay has expired, a roll-delivery-element-roll-engaging-element-position sensor indicates that the roll-engaging element has reached the upper limit of its travel, or until a roll-delivery-element roll-detection sensor indicates the presence of the remnant at a predetermined location. This motion removes the remnant from the roll-removal position.

The roll-stop roll-detection sensor indicates to the controller that the remnant has been removed from the roll-removal position. After a predetermined time delay to provide time for the roll-delivery element to lift the remnant clear of the roll stop, the controller commands the extension-element end effector to transition the extension element from the extended position to the retracted position. The motion is halted when the extension-element-position sensor indicates that the extension element has reached the retracted position.

After the extension-element-position sensor indicates that the extension element has reached the retracted position, the controller commands the trolley to transition from the roll-loading station to the roll-unwinding position. The motion of the trolley is halted when the trolley-position sensor indicates that the trolley has reached the roll-unwinding position.

All documents cited in the Detailed Description of the invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of the invention.

What is claimed is:

1. A roll-handling apparatus for removing a remnant of a first roll and placing a subsequent roll, the subsequent roll having a radius of about R, the apparatus comprising:

a) a dump cradle capable of transitioning between a roll-support position and a roll-release position, b) a roll-transfer surface comprising an extension element capable of transitioning from a retracted position to an extended position, the roll-transfer surface capable of receiving the remnant of the first roll from the dump cradle, and transferring the remnant to the extended position, c) a roll-delivery element capable of carrying and placing the subsequent roll in the dump cradle and of removing the remnant from a remnant removal position.

2. The roll-handling apparatus of claim 1 further comprising a roll engaging element capable of releasably engaging the remnant of the first roll.

3. The roll-handling apparatus according to claim 2 wherein the remnant comprises an ejector.

4. The roll-handling apparatus according to claim 1 further comprising a trolley capable of transitioning between a roll-loading position and a roll-unwinding position.

5. The roll-handling apparatus according to claim 1 wherein the retracted position of the extension element is disposed less than the radius R from the dump cradle, and the extended position of the extension element is disposed more than the radius R from the dump cradle.

6. The roll-handling apparatus according to claim 1 further comprising a position sensor selected from the group consisting of: a dump-cradle sensor, a roll-delivery-element sensor, an extension-element sensor, and combinations thereof.

7. The roll-handling apparatus according to claim 1 further comprising an extension-element end effector capable of transitioning the extension element between the retracted position and the extended position.

8. The roll-handling apparatus according to claim 1 further comprising a dump-cradle end effector capable of transitioning the dump cradle between the roll-support position and the roll-release position.

9. A roll-handling apparatus comprising:

a) a roll-unwinding station capable of accepting web material unwound from a roll, the roll having an initial radius of about R, b) a roll-loading station capable of receiving a roll to be unwound, c) a roll-delivery element capable of removing a remnant of a roll from a remnant-removal position, of providing a roll at the roll-loading station and of placing the roll in a dump cradle, d) a trolley capable of transitioning between the roll-unwinding station and the roll-loading station, the trolley comprising:

i) the dump cradle capable of transitioning between a roll-support position and a roll-release position, ii) a roll-transport surface comprising an extension element capable of transitioning from a retracted position to an extended position and capable of receiving the remnant from the dump cradle and transferring the remnant to the extended position.

10. The roll-handling apparatus of claim 9 further comprising a roll-engaging element capable of releasably engaging the remnant of the first roll.

11. The roll-handling apparatus according to claim 10 wherein the remnant comprises an ejector.

12. The roll-handling apparatus according to claim 9 wherein the retracted position of the extension element is disposed less than the radius R from the dump cradle, and the extended position of the extension element is disposed more than the radius R from the dump cradle.

13. The roll-handling apparatus according to claim 9 further comprising a position sensor selected from the group consisting of: a dump-cradle position sensor, a roll-delivery-element position sensor, an extension-element position sensor, and combinations thereof.

14. The roll-handling apparatus according to claim 9 further comprising an extension-element end effector capable of transitioning the extension element between the retracted position and the extended position.

15. The roll-handling apparatus according to claim 9 further comprising a dump-cradle end effector capable of transitioning the dump cradle between the roll-support position and the roll-release position.

16. A roll-handling apparatus for unwinding rolls of web material, the apparatus comprising:

a) a roll-unwinding station capable of accepting web material unwound from a roll, the roll having an initial radius of about R, b) a first roll-loading station capable of receiving a roll of web material, c) a second roll-loading station capable of receiving a roll of web material, d) a roll-delivery element capable of providing a roll of web material to at least the first roll-loading station, of placing the roll in a dump cradle, and of removing a remnant of a roll from a roll-removal position, e) a trolley capable of transitioning between the first roll-loading station, the roll-unwinding station, and the second roll-loading station, the trolley comprising:

i) the dump cradle capable of transitioning between a roll-support position and a roll-release position, ii) a roll-transport surface comprising an extension element capable of transitioning from a retracted position to an extended position, the roll-transport surface capable of receiving the remnant from the dump cradle, and transferring the remnant to the extended position, the extended position being disposed more than the radius R away from the dump cradle.

17. The roll-handling apparatus of claim 16 further comprising a roll-engaging element capable of releasably engaging the remnant of the first roll.

18. The roll-handling apparatus according to claim 17 wherein the remnant comprises an ejector.

19. The roll-handling apparatus according to claim 16 wherein the retracted position of the extension element is disposed less than the radius R from the dump cradle, and the extended position of the extension element is disposed more than the radius R from the dump cradle.

20. The roll-handling apparatus according to claim 16 further comprising a position sensor selected from the group consisting of: a dump-cradle position sensor, a roll-delivery position sensor, a trolley position sensor, an extension-element position sensor and combinations thereof.

* * * * *